US007841471B2

(12) United States Patent
Tagliaferri

(10) Patent No.: US 7,841,471 B2
(45) Date of Patent: Nov. 30, 2010

(54) SUPPORTING STRUCTURE FOR STORING AND HANDLING SO-CALLED "BARRIQUES"

(75) Inventor: Luca Tagliaferri, Florence (IT)

(73) Assignee: Marchesi Antinori S.r.l., Florence (IT)

( * ) Notice: Subject to any disclaimer, the term of this patent is extended or adjusted under 35 U.S.C. 154(b) by 144 days.

(21) Appl. No.: 12/132,216

(22) Filed: Jun. 3, 2008

(65) Prior Publication Data

US 2008/0283436 A1 Nov. 20, 2008

(30) Foreign Application Priority Data

Apr. 6, 2007 (IT) ..... FI2007A0126

(51) Int. Cl.
*B62B 1/00* (2006.01)

(52) U.S. Cl. ..... 206/501; 206/596; 206/504

(58) Field of Classification Search ..... 206/501, 206/596; 280/79.6, 47.18, 47.28; 211/59.4, 211/74, 85.22
See application file for complete search history.

(56) References Cited

U.S. PATENT DOCUMENTS

| | | | | |
|---|---|---|---|---|
| 2,763,383 | A * | 9/1956 | McCoy | 414/542 |
| 3,019,916 | A * | 2/1962 | Malcher | 206/596 |
| 4,431,107 | A * | 2/1984 | Bergstrom et al. | 211/59.4 |
| 4,488,649 | A * | 12/1984 | Mark | 211/49.1 |
| 4,506,796 | A * | 3/1985 | Thompson | 211/59.4 |
| 5,720,397 | A * | 2/1998 | Thompson | 211/59.4 |
| 5,913,527 | A * | 6/1999 | Hailston | 280/47.28 |
| 5,984,119 | A * | 11/1999 | Uhl | 211/59.4 |
| 6,050,538 | A * | 4/2000 | Marrow et al. | 248/505 |
| 6,290,074 | B1 * | 9/2001 | Syvuk et al. | 211/74 |
| 6,302,414 | B1 * | 10/2001 | Berthiaume et al. | 280/47.18 |
| 6,637,607 | B2 * | 10/2003 | Tombu | 211/85.22 |
| 7,195,257 | B2 * | 3/2007 | Stoneback et al. | 280/79.6 |
| 7,448,505 | B2 * | 11/2008 | DeMent | 211/59.4 |
| 7,494,308 | B2 * | 2/2009 | Chun | 410/47 |
| 2006/0081549 | A1 * | 4/2006 | Gracia Lecina | 211/85.22 |
| 2006/0131825 | A1 * | 6/2006 | Stoneback et al. | 280/79.6 |

FOREIGN PATENT DOCUMENTS

| | | |
|---|---|---|
| EP | 0 953 305 A1 | 11/1999 |
| GB | 659 005 | 10/1951 |
| GB | 1 153 947 | 6/1969 |
| WO | WO 00/58162 | 10/2000 |
| WO | WO 02/43529 A1 | 6/2002 |

* cited by examiner

*Primary Examiner*—Anthony Stashick
*Assistant Examiner*—Cynthia F Collado
(74) *Attorney, Agent, or Firm*—McGlew and Tuttle, P.C.

(57) ABSTRACT

The structure comprises two saddles (15) connected to each other, each of which is shaped in such a way as to form, at one side, two seats, on which two flanked barriques rest, and to form at the opposite side at least an-intermediate seat for resting on a barrique. The saddles form two housings (20) for the forks of a lifting means.

12 Claims, 6 Drawing Sheets

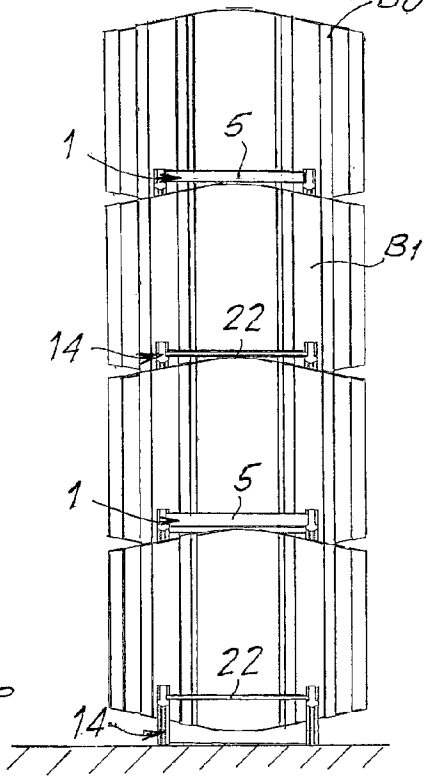
Fig.19
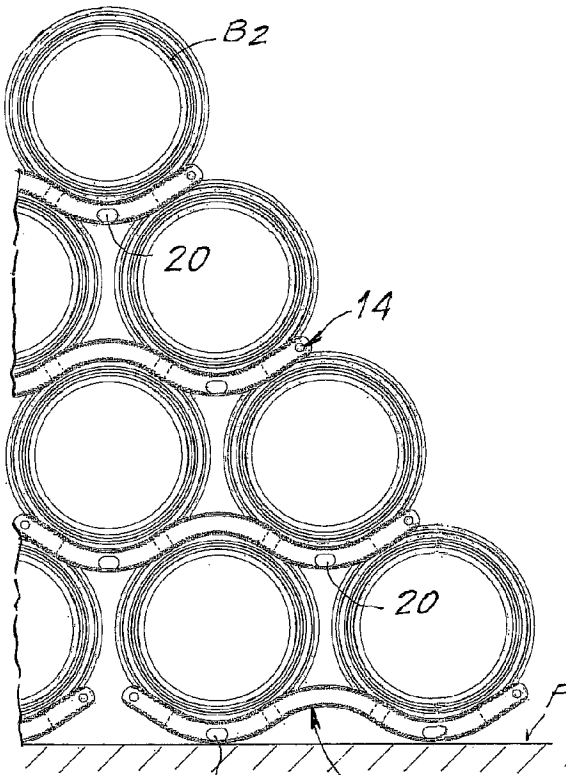
Fig.18
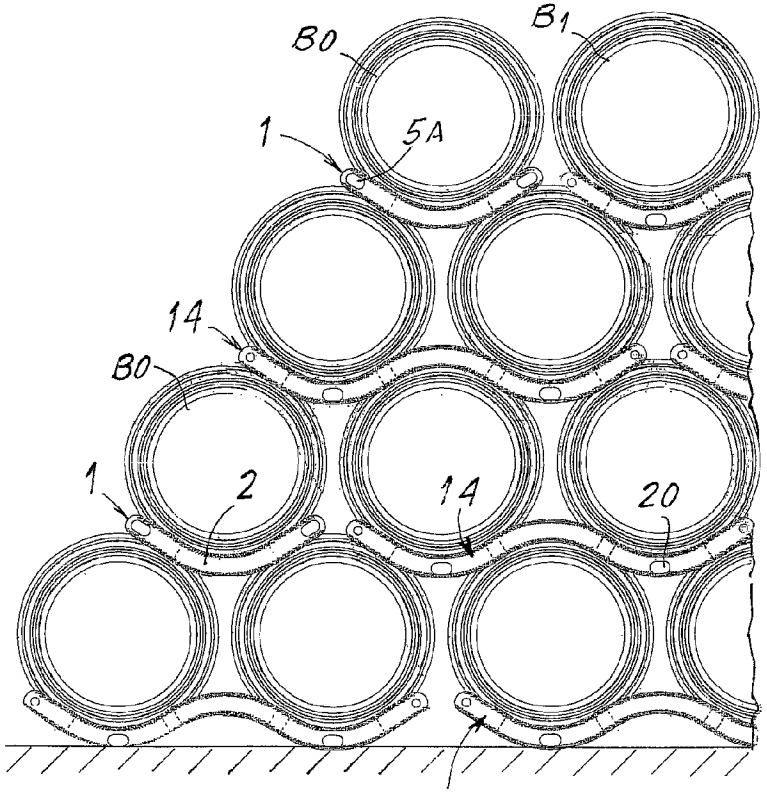
XIX
XIX

SUPPORTING STRUCTURE FOR STORING AND HANDLING SO-CALLED "BARRIQUES"

FIELD OF THE INVENTION

The present invention relates to structures and devices for storing and/or handling small barrels, such as the so-called "barriques", widely used in wineries.

BACKGROUND ART

Fundamental needs for the design of the structures in question are required by the geometry and the weight of the various barriques, in order to construct structures, which are useful for the different types of barrique, having slightly different measures and all with a total weight, when full, in the order of about 300 kg.

The barriques are used for wine refinement, which can take place both in industrial environments and in entertaining rooms destined to house also visitors, and where the aesthetical appearance is therefore more important. In the first case, the reduction in positioning times, the maintenance and handling of barriques must allow low administration costs; in known solutions, the barriques were positioned coupled onto metallic frames, constructed with profiles in steel or aluminum, or wood, which allow fast handling through lifting equipment and forklifts.

For a safe and easy engagement by the forklifts, the frames must provide for very precautionary spaces for engaging the lifting means, that on the other hand increase spaces between the barriques and decrease the storing capacity of the rooms; generally, this disadvantage is tolerated or compensated through greater volumes of the storing environments, which can be designed in the modern realities. The steel or aluminum frame for barriques is therefore suitable for the purpose for which it has been designed.

Other alternate systems have been studied to find increasingly great benefits—in storing and handling—to the detriment of the traditional aesthetic appearance of the wooden barrique.

All these solutions can not be applied in those realities in which the "tradition" is an important feature, i.e. where, around the barriques, particularly suggestive atmospheres are created, respectful of the wine and of the ancient tradition of wine producers. Currently, in these places, defined as "wine temples", the barriques are generally positioned on elements made of typical woods such as durmast oak or oak; the most utilized solutions consist in positioning on beams, saddles or simple wedges interposed between the barriques.

In some cases, attempts have been made to combine the above mentioned requirements through the construction of wooden supports with possibility of handling, in particular with saddles suitable to be forked by the forklifts for the handling of the single barriques. However, the modest mechanical features of wood do not allow construction of frames for the required contemporaneous handling of at least two barriques.

SUMMARY OF THE INVENTION

According to one aspect, the present invention provides a structure, which solves at least partly one or more of the various problems described above.

More specifically, the subject of one embodiment of the invention is a complex comprising a new type of structure for storing and handling barriques in the wineries.

The structure in question has been studied to satisfy particular requirements, among which those indicated below:

1) aesthetically pleasant and valuable features, of at least the same level as the wooden articles generally used as supporting frames in the entertaining rooms (that on the other hand do not have the maximum efficiency in maintenance and use);
2) features of mechanical strength of at least the same level as those of the frames, in steel or aluminum alloy, available on the market (that however do not have a pleasant appearance), in order to allow fast and safe handling through lifting equipment and forklifts.

A first substantial subject of the present invention is a supporting structure for the storage of the so-called "barriques", which comprises two frames i.e. saddles, each of which is shaped in such a way as to form, at one side, at least two seats suitable to form a rest for two barriques arranged side by side, and to form, at the opposite side, at least an intermediate seat and rests on barriques which are below the two said flanked barriques.

According to some preferred embodiment, at least one frame and preferably each said frames or saddles form housings for engagement by the forks of the lifting means or other lifting devices. In some preferred embodiments, therefore, housings are provided on or accessible from each side of the structure, such that said structure can be engaged at both sides by means of lifting forks or the like. Said housings can be formed in the two undulated sections or section bars, forming the saddles, or else they can be formed in transverse rods connecting said two undulated sections.

According to some embodiments the saddles are shaped in such a way as to contact the barriques between the metallic hoops or near said hoops, which are typical of the barriques. Anyway, it is possible to use wedges to compensate for any dimensional difference and to ensure stability to the contacts between saddles and barriques.

In addition to the previously mentioned structure, a supporting structure is advantageously provided, which comprises two saddles, each of which is shaped in such a way as to form a seat for receiving one barrique, and two opposite ends with opposite rest curvatures. According to some preferred embodiments, towards each of said ends a housing is advantageously provided, for engagement by the forks of a lifting means or other lifting devices.

An embodiment is also feasible, in which each saddle can be designed so as to form at one side two seats and, at the opposite side, three seats for barriques.

According to some embodiments, the two saddles of each structure are connected by means of at least two tie rods, preferably positioned in such a way as not to interfere with the central portions of the barriques resting on the seats. In some embodiments two tie rods may be constructed as tubular bars in order to constitute the two housings suitable to receive and guide the forks of the lifting means or other lifting device in an easy manner.

The saddles may be formed by sections, such as extruded section bars, with a full or hollow body, shaped in such a way as to combine strength, bulk and aesthetics.

The seats may receive wedges suitable to contrast between the saddle and the barrique to complete and to ensure stability, compensating any dimensional variations, especially in the diameters of the barriques.

BRIEF DESCRIPTION OF THE DRAWINGS

The invention shall now be better understood by following the description and the accompanying drawing, which shows non-limiting practical embodiments of the invention. In the drawing:

FIGS. 18 and 19 show a stack of barriques in partial front view and in lateral view.

DETAILED DESCRIPTION OF SOME EMBODIMENTS OF THE INVENTION

Figure 2:
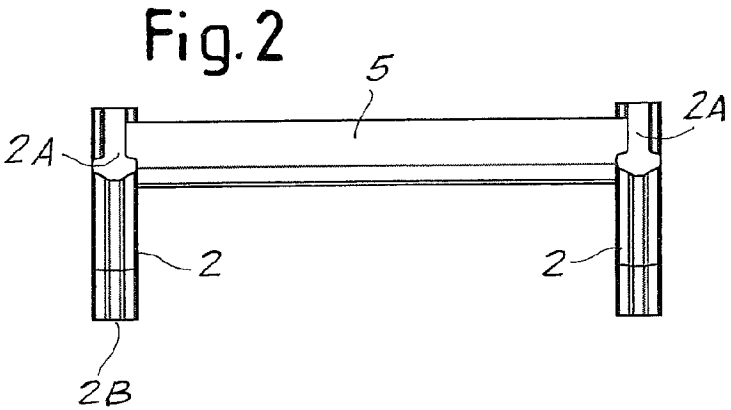
FIGS. 1 to 3 show a structure with a single seat useful for one barrique, in front, lateral and perspective view.
Figure 1:
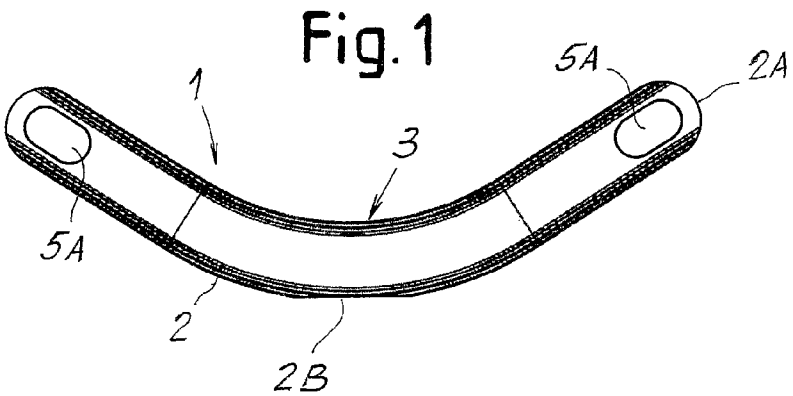
Figure 3:
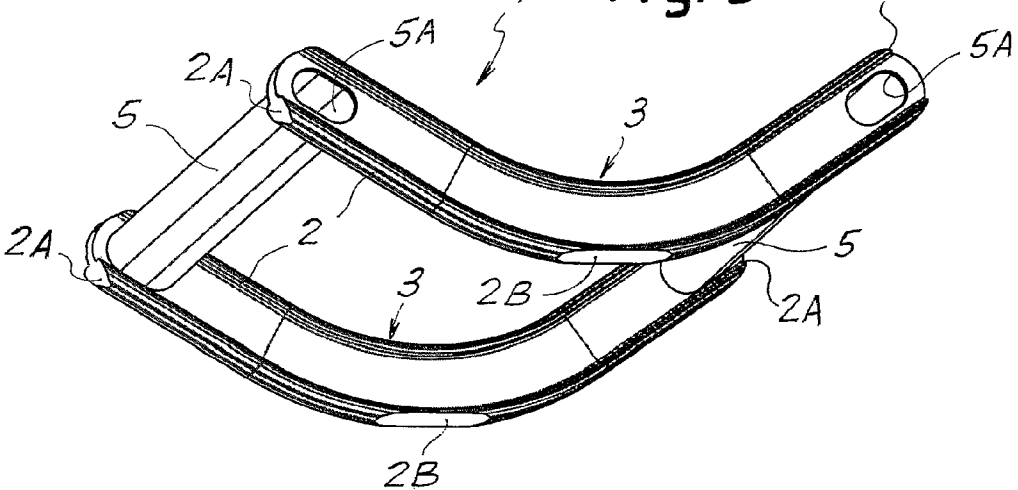
Figure 5:
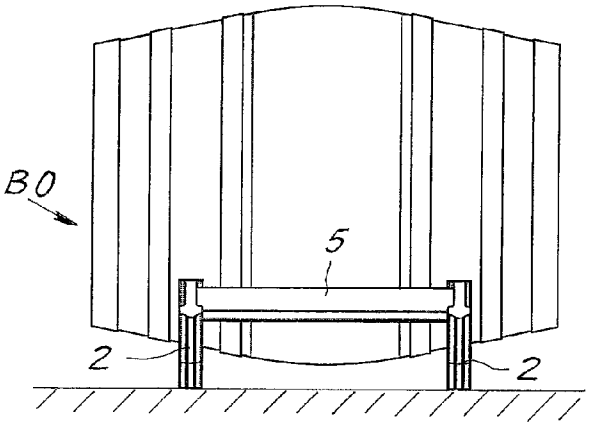
FIGS. 4, 5, and 6 show said structure with a barrique resting on it.
Figure 4:
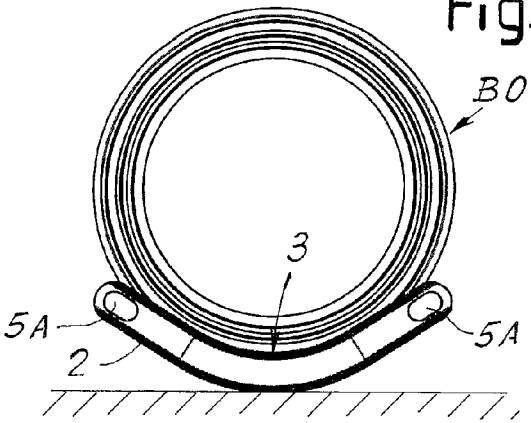
Figure 6:
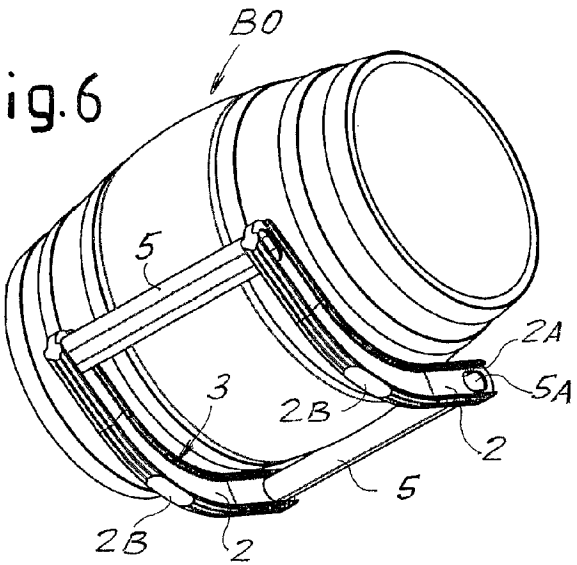

FIGS. 1 to 6 show the embodiment of a structure 1 constituted by two undulated saddles 2, each of which forms a seat 3. The two seats 3 are aligned to receive one barrique B0 (see FIGS. 4 to 6) and each has two ends 2A connected by means of tubular, i.e. hollow bars 5, which are welded or anyway connected to the seats, and which can be accessed through end windows or apertures 5A, through which the forks of the lifting and handling means, such as the forks of the so-called forklifts, can penetrate. In some embodiments the bars 5 are made of hollow sections, such as extruded metal sections, while the saddles 2 are formed by solid, i.e. non-hollow sections, such as metal sections. The seats 3 are suitable to receive one barrique B0, which can rest at two points on each seat 3. The saddles 2 are suitable to rest on two underlying barriques, such as the barriques B1, B2 of FIG. 18. The saddles 2 can be stabilized on the floor P or on rest elements with the aid, if necessary, of wedges. In some embodiments, the saddles 2 can be provided with a flattened portion 2B, i.e. a leveling 2B, forming a floor resting surface.

Figure 8:
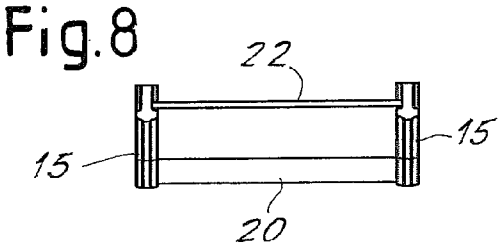
FIGS. 7 to 10 show a structure forming two seats.
Figure 10:
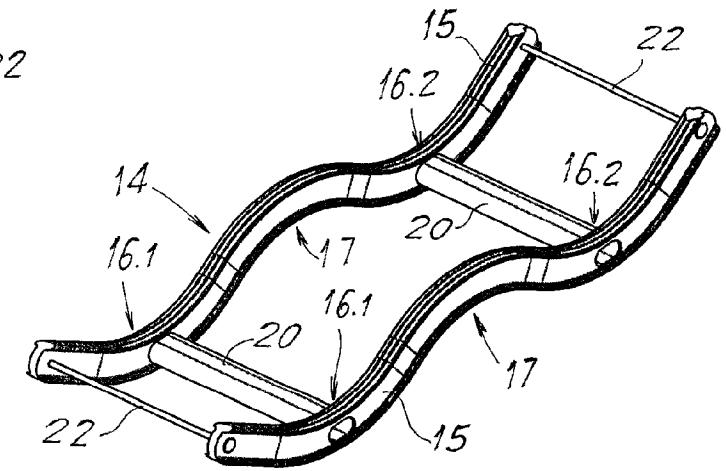
Figure 7:
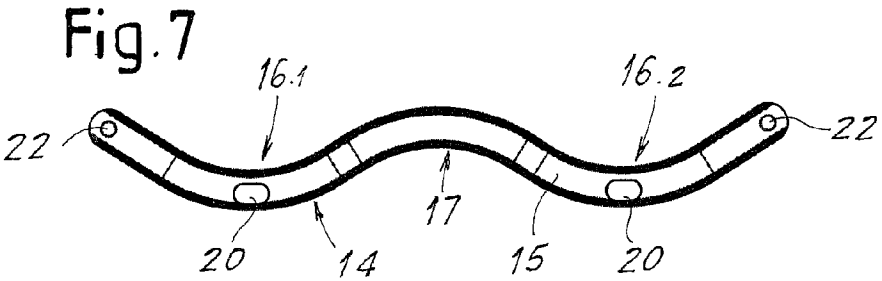
Figure 9:
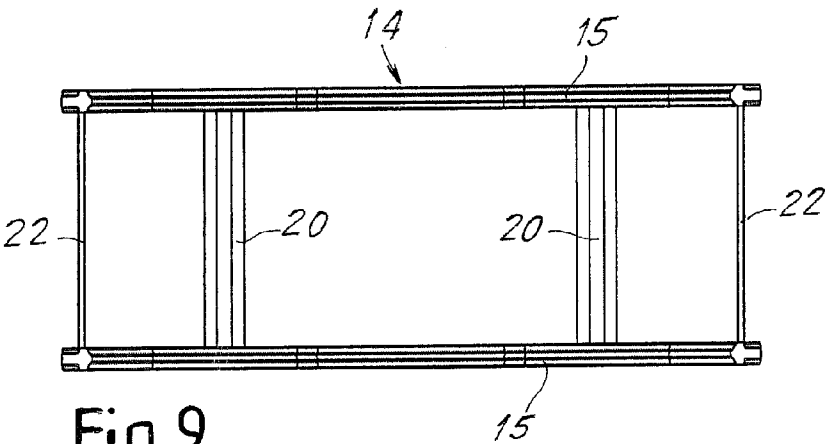
Figure 12:
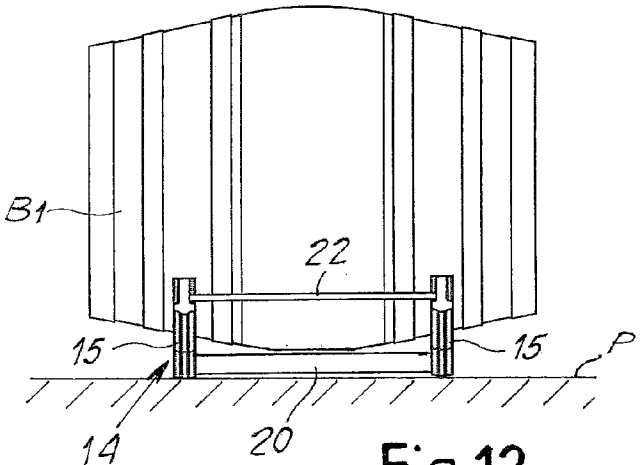
FIGS. 11 to 13 show said structure with the two barriques resting on it.
Figure 11:
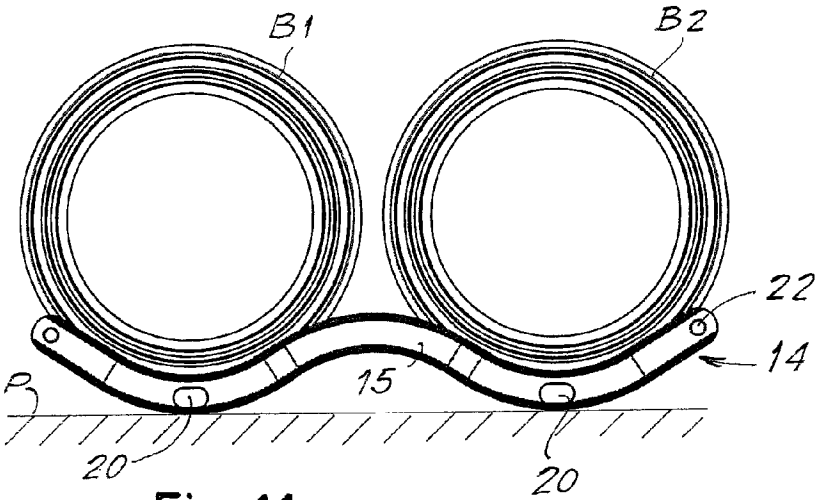
Figure 13:
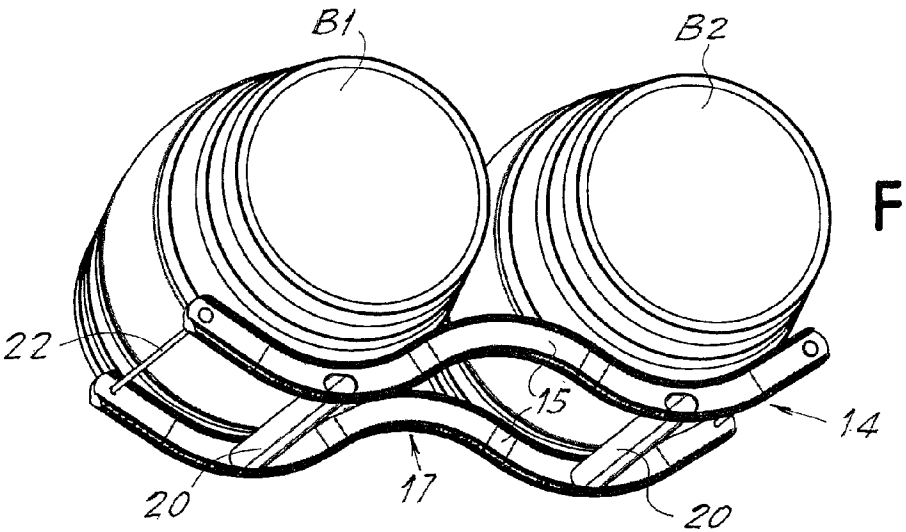

FIGS. 7 to 13 show a main structure 14 designed for receiving two barriques B1 and B2; said structure can rest on the floor P (FIG. 11) or on an underlying series of barriques, as shown in FIG. 18. Said structure 14 comprises two rest saddles 15 with undulated shape, each of which forms two upper seats $\mathbf{16}_1$ and $\mathbf{16}_2$ (FIGS. 7, 10) for two barriques B1 and B2 and with a lower seat 17 for one of the underlying barriques, if any (see FIG. 18). The barriques contact the respective seats $\mathbf{16}_1$ and $\mathbf{16}_2$ in two points. The two saddles 3 are mutually connected by means of tubular, i.e. hollow bars 20, duly positioned in such a way as not to interfere with the central portions of greater diameter of the barriques. Said bars 20 are spaced apart from one another in order to allow penetration into them by the forks of the lifting and handling means, such as the forklifts.

The barriques B1 and B2 are positioned in the seats $\mathbf{16}_1$ and $\mathbf{16}_2$ either directly or with the aid of wedges, depending upon the diameter of the barriques in the rest areas of the seat on the saddles 15.

Figure 15:
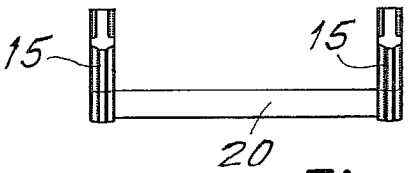
FIGS. 14 to 17, similarly to FIGS. 7 to 10, show a modified embodiment.
Figure 17:
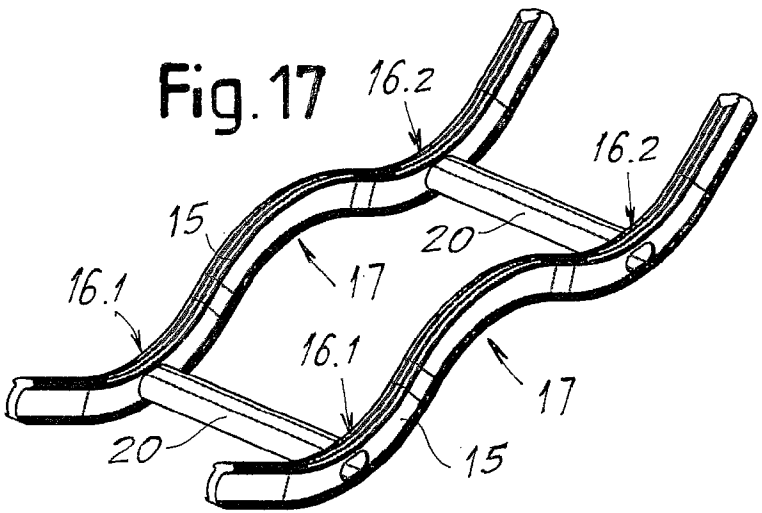
Figure 14:
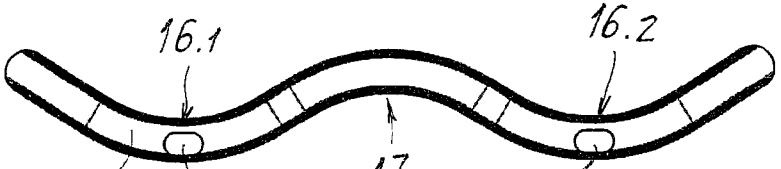
Figure 16:
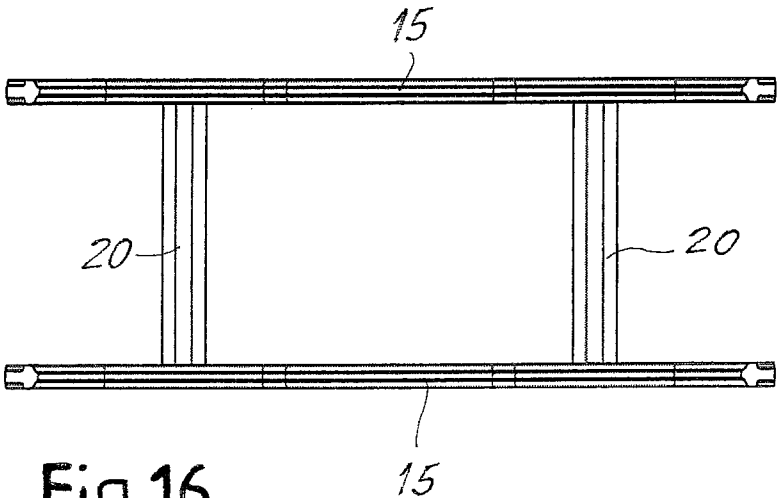

In the embodiment shown in FIGS. 7 to 13, the two saddles 15 can be connected to each other, not only through the tubular, i.e. hollow bars 20, but also through rods 22 connected at the ends of the saddles 15. Connection can be provided by welding or in other suitable way. In the modified embodiment of FIGS. 14 to 17, the rods 22 are not present, and connection is provided only by means of the tubular bars 20, which can be used for the engagement by the forks of the lifting and handling means, such as the traditional forklifts.

In both embodiments described (either with one or two seats) housings for the forks of a lifting means (forklifts or similar) or other lifting devices are provided, said housings being preferably formed by the connecting bars 5 and 20. In some preferred embodiments, the tubular bars 5 and 20 for connecting the two saddles 2 and 15 and which form said housings for the forks of the lifting means or forklifts (which, in this way, are guided in a simple manner), have an over-dimensioned cross-section at least in horizontal direction, in order to make the insertion of the forks of the lifting means easy and to receive within the windows or apertures formed in said bars also forks with slightly different center distance.

FIG. 18 schematically shows the arrangement of a plurality of barriques on various levels, using the structures 14 with double seats such as those of FIGS. 7 to 17, with suitable staggered distribution in the various levels of the barriques, with easy adaptations depending on the availability of horizontal and vertical spaces. In some end positions, components or structures 1 as shown in FIGS. 1 to 6 can be used.

FIG. 19 shows an end area, in which elements with two seats alternate with elements with single seat.

The construction of the structures as described—duly treated at least on the visible surfaces—is suitable both for industrial stacking of the barriques in wide rooms suitable for the purpose, as well as for an arrangement aesthetically equivalent to that currently formed with stacking elements of the traditional type. Therefore, the equipment as described above allows to organize also rooms for exhibition to the customers, irrespective of the use in the "industrial" field.

It is understood that the drawing merely shows an example provided purely as a practical embodiment of the invention, which may vary in forms and arrangements without however departing from the scope of the concept underlying the invention. Any reference numbers in the appended claims are provided for the sole purpose of facilitating reading in the light of the description and the drawing, and do not in any manner limit the scope of protection represented by the claims.

What I claim is:

1. A supporting structure for storing barriques, comprising:

a plurality of hollow longitudinal connecting bars, wherein each of said longitudinal connecting bars comprises a longitudinal hollow space, said longitudinal hollow space defining a longitudinal housing for a fork of a lifting device;

at least one pair of undulated saddles mutually connected by means of said longitudinal connecting bars, each of said saddles comprising an upper part, each saddle being shaped in the upper part in such a way as to form at least two upper seats for two barriques arranged side by side and a lower seat for an underlying barrique, said lower seat being arranged in an intermediate position between said two upper seats, each of said saddles comprising a lower part, said saddles forming extensions in said lower part for contacting two underlying flanked barriques, said saddles being formed by two undulated section bars, one or more of said saddles comprising a plurality of apertures, each of said connecting bars being connected to said saddles, wherein each of said connecting bars is aligned with one of said apertures in at least one of said saddles, said longitudinal hollow space of each of said connecting bars being in communication with said one of said apertures in said at least one of said saddles.

2. A structure as claimed in claim 1, wherein said seats are shaped in such a way as to contact between metallic hoops of the barriques.

3. A structure as claimed in claim 1, wherein the housings for the forks have a substantially horizontally elongated section.

4. A structure as claimed in claim 1, wherein the connecting bars are positioned in such a way as not to interfere with the central area(s) of the barriques resting on the seat(s).

5. A structure as claimed in claim 1, wherein said hollow longitudinal connecting bars are arranged symmetrically with respect to said lower seat.

6. A structure as claimed in claim 1, wherein said hollow bars are arranged at a distance from a surface of contact between said seats and the respective barrique, such that said bars do not interfere with the barriques when said barriques are placed on said seats.

7. A structure as claimed in claim 1, wherein said two saddles are further connected by end bars, one of said end bars being located at a first distance from another one of said end bars, one of said hollow longitudinal connecting bars being located at a second distance from another one of said hollow longitudinal connecting bars, said first distance being greater than said second distance.

8. A structure as claimed in claim 1, wherein said saddles form at one side two seats and at an opposite side three seats.

9. A system for storing barriques, the system comprising:

a first structure comprising at least one pair of first undulated saddles and a plurality of hollow longitudinal connecting bars, wherein each of said longitudinal connecting bars comprises a longitudinal hollow space, said longitudinal hollow space defining a longitudinal housing for a fork of a lifting device, said at least one pair of first undulated saddles being connected by said longitudinal connecting bars, each of said first saddles comprising an upper part, each of said first saddles being shaped in the upper part in such a way as to form at least two upper seats for two barriques arranged side by side and a lower seat for an underlying barrique, said lower seat being arranged in an intermediate position between said two upper seats, each of said first saddles comprising a lower part, said saddles forming extensions in said lower part for contacting two underlying flanked barriques, said first saddles being formed by two undulated section bars, one or more of said first saddles comprising a plurality of apertures, each of said connecting bars being connected to said first saddles, wherein each of said connecting bars is aligned with one of said apertures in at least one of said first saddles, said longitudinal hollow space of each of said connecting bars being in communication with said one of said apertures in said at least one of said first saddles; and a second structure comprising a pair of second saddles, each of said second saddles comprising a second upper part and a second lower part, said second upper part being shaped in such as a way as to form one seat for receiving one barrique, each of said second saddles comprising extensions in said second lower part for contacting two underlying barriques.

10. A system in accordance with claim 9, wherein said pair of second saddles comprise second section bars, each of said second section bars forming said one seat, said one seat of one of said second section bars being aligned with said one seat of another one of said second section bars for receiving the one barrique, said second structure comprising a plurality of second hollow bars, each of said second hollow bars comprising a second longitudinal space, said second longitudinal hollow space defining a second longitudinal housing for a fork of a lifting device, each of said second section bars having two ends, each end of one of said second section bars being connected to one end of another one of said second section bars via one of said second hollow bars, said second saddles comprising a plurality of apertures, wherein each of said second hollow bars is aligned with one of said apertures in at least one of said second saddles, said second lower part having a flattened portion.

11. A supporting structure for storing barrels, comprising:

a first hollow longitudinal connecting bar defining a first longitudinal space for receiving one fork of a lifting device;

a second hollow longitudinal connecting bar comprising a second longitudinal space for receiving another fork of the lifting device;

a first support element comprising a first arcuate portion;

a second support element comprising a second arcuate portion, said first arcuate portion and said second arcuate portion defining a means for receiving one barrel, one or more of said first support element and said second support element comprising a plurality of apertures, said first support element being connected to said second support element via said first hollow longitudinal connecting bar and said second hollow longitudinal connecting bar, said first hollow longitudinal bar being aligned with one of said apertures in said one or more of said first support element and said second support element, said second hollow longitudinal bar being aligned with another one of said apertures in said one or more of said first support element and said second support element, said first longitudinal space being in communication with said one aperture in said one or more of said first support element and said second support element, said second longitudinal space being in communication with said another one of said apertures in said one or more of said first support element and said second support element, said first hollow longitudinal connecting bar and said second hollow longitudinal connecting bar defining a means for receiving a force from one or more forks of the lifting device and for distributing the force to said first support element and said second support element.

12. A supporting structure in accordance with claim 11, wherein said first support element comprises yet another first arcuate portion connected to said first arcuate portion to define a first support structure with at least one undulation, said first support structure comprising a first lower portion, said first lower portion comprising a first lower seat portion, said first lower seat portion being arranged between said first arcuate portion and said yet another arcuate portion, said first lower portion comprising a first extension at each end portion of said first support structure, wherein said second support element comprises yet another second arcuate portion, said yet another second arcuate portion being connected to said second arcuate portion to define a second support structure with at least one undulation, said second support structure comprising a second lower portion, said second lower portion comprising a second lower seat portion, said second lower seat portion being arranged between said second arcuate portion and said yet another second arcuate portion, said second lower portion comprising a second extension at each end portion of said second support structure, said first arcuate portion being aligned with said second arcuate portion, said yet another first arcuate portion being aligned with said yet another second arcuate portion, said yet another first arcuate portion and said yet another second arcuate portion defining a means for receiving a second barrel, said first lower seat portion being aligned with said second lower seat portion to define a lower seat for contacting an underlying barrel, each of said first extensions being aligned with one of said second extensions, one of said first extensions and one of said second extensions for engaging a portion of another underlying barrel located on one side of the underlying barrel, another one of said first extensions and another one of said second extensions for engaging a portion of yet another underlying barrel located on another side of the underlying barrel.

* * * * *